US010497315B2

(12) United States Patent
Meng et al.

(10) Patent No.: US 10,497,315 B2
(45) Date of Patent: Dec. 3, 2019

(54) BRIGHTNESS CONTROL METHOD, BRIGHTNESS CONTROL DEVICE, ACTIVE-MATRIX ORGANIC LIGHT-EMITTING DIODE PANEL AND ELECTRONIC DEVICE

(71) Applicants: BOE TECHNOLOGY GROUP CO., LTD., Beijing (CN); BEIJING BOE OPTOELECTRONICS TECHNOLOGY CO., LTD., Beijing (CN)

(72) Inventors: Zhaohui Meng, Beijing (CN); Dong Chen, Beijing (CN); Xue Dong, Beijing (CN)

(73) Assignees: BOE TECHNOLOGY GROUP CO., LTD., Beijing (CN); BEIJING BOE OPTOELECTRONICS TECHNOLOGY CO., LTD., Beijing (CN)

( * ) Notice: Subject to any disclaimer, the term of this patent is extended or adjusted under 35 U.S.C. 154(b) by 0 days.

(21) Appl. No.: 15/578,640

(22) PCT Filed: Jun. 22, 2017

(86) PCT No.: PCT/CN2017/089475
§ 371 (c)(1),
(2) Date: Nov. 30, 2017

(87) PCT Pub. No.: WO2018/054108
PCT Pub. Date: Mar. 29, 2018

(65) Prior Publication Data

US 2018/0308429 A1 Oct. 25, 2018

(30) Foreign Application Priority Data

Sep. 26, 2016 (CN) ..... 2016 1 0851741

(51) Int. Cl.
*G09G 3/3258* (2016.01)
*G09G 3/3275* (2016.01)
(Continued)

(52) U.S. Cl.
CPC ..... *G09G 3/3258* (2013.01); *G09G 3/3225* (2013.01); *G09G 3/3275* (2013.01);
(Continued)

(58) Field of Classification Search
CPC .. G09G 3/3258; G09G 3/3225; G09G 3/3275; G09G 3/3233; G09G 3/3406;
(Continued)

(56) References Cited

U.S. PATENT DOCUMENTS 8,643,681 B2 * 2/2014 Endo ..... H04N 9/3111 345/204
2008/0001881 A1 * 1/2008 Baba ..... G09G 3/3406 345/89
(Continued)

FOREIGN PATENT DOCUMENTS

CN 101000758 A 7/2007
CN 101051443 A 10/2007
(Continued)

OTHER PUBLICATIONS

First Chinese Office Action, for Chinese 201610851741.X, dated Nov. 14, 2017, 16 pages.
(Continued)

*Primary Examiner* — Fred Tzeng
(74) *Attorney, Agent, or Firm* — Kinney & Lange, P.A.

(57) ABSTRACT

The present disclosure provides a brightness control method, a brightness control device, an AMOLED panel and an electronic device. The brightness control method includes steps of: determining a brightness value L to be displayed by the AMOLED panel in accordance with a received bright-
(Continued)

ness adjustment instruction; calculating an actual brightness value L' to be outputted by the electroluminescent element corresponding to the brightness value L in accordance with a predetermined brightness relationship, the actual brightness value L' corresponding to one grayscale; and controlling a data output unit to output a voltage signal corresponding to the actual brightness value L'.

18 Claims, 3 Drawing Sheets

(51) Int. Cl.
*G09G 3/3225* (2016.01)
*G09G 3/34* (2006.01)

(52) U.S. Cl.
CPC ... *G09G 3/3406* (2013.01); *G09G 2320/0276* (2013.01); *G09G 2320/0285* (2013.01); *G09G 2320/062* (2013.01); *G09G 2320/0626* (2013.01); *G09G 2320/0673* (2013.01)

(58) Field of Classification Search
CPC .... G09G 3/342; G09G 3/3426; G09G 3/2074; G09G 3/3241; G09G 3/32018; G09G 3/2007; G09G 3/2022; G09G 3/36; G09G 3/006
USPC ..... 345/690
See application file for complete search history.

(56) References Cited

U.S. PATENT DOCUMENTS

2008/0170014 A1* 7/2008 Jung ..... G09G 3/3233 345/82
2009/0284181 A1* 11/2009 Kim ..... G09G 3/3426 315/307
2010/0188443 A1* 7/2010 Lewis ..... G02B 26/02 345/691
2011/0007101 A1 1/2011 Mori
2011/0069095 A1* 3/2011 Kim ..... G09G 3/342 345/690
2011/0102417 A1* 5/2011 Chen ..... G09G 3/3233 345/214
2011/0279437 A1* 11/2011 Komiya ..... G09G 3/3233 345/212
2012/0032995 A1 2/2012 Lee
2013/0249955 A1* 9/2013 Kim ..... G09G 3/3233 345/690
2013/0314457 A1* 11/2013 Yasui ..... G09G 3/36 345/691
2013/0328487 A1* 12/2013 Yoshida ..... G03G 15/043 315/152
2014/0160173 A1* 6/2014 Lee ..... G09G 3/3225 345/690
2016/0086541 A1* 3/2016 Yang ..... G09G 3/3258 345/691
2016/0232848 A1* 8/2016 Meng ..... G09G 3/3258
2016/0307490 A1* 10/2016 Lee ..... G09G 3/2022
2016/0314728 A1* 10/2016 Ding ..... G09G 3/006
2016/0322001 A1* 11/2016 Do ..... G09G 3/2007
2017/0047035 A1 2/2017 Li et al.
2017/0061896 A1* 3/2017 Zhang ..... G09G 3/3426
2017/0061897 A1* 3/2017 Zhang ..... G09G 3/3426
2017/0061901 A1* 3/2017 Zhang ..... G09G 3/3426
2017/0061902 A1* 3/2017 Zhang ..... G09G 3/3426
2017/0084232 A1* 3/2017 Yang ..... G09G 3/3426
2017/0110064 A1* 4/2017 Zhang ..... G09G 3/2018
2017/0110065 A1* 4/2017 Zhang ..... G09G 3/2018
2017/0169767 A1* 6/2017 Song ..... G09G 3/3241
2017/0193909 A1* 7/2017 Song ..... G09G 3/2074
2017/0263190 A1* 9/2017 Yashiki ..... G02F 1/133621

FOREIGN PATENT DOCUMENTS

CN 101600120 A 12/2009
CN 101950532 A 1/2011
CN 103680449 A 3/2014
CN 105070252 A 11/2015
CN 105741762 A 7/2016
CN 105761672 A 7/2016
CN 106157897 A 11/2016

OTHER PUBLICATIONS

International Search Report & Written Opinion (with English translation of Box V) for PCT Patent Application No. PCT/CN2017/089475, dated Sep. 18, 2017, 15 pages.

* cited by examiner

Fig. 3
| Page0 | 0x00 | 0x 01 | 0x 02 | …… | 0x3D | 0x3E | 0x3F |
|---|---|---|---|---|---|---|---|
| 0 | GL0 | GL1 | GL2 | …… | GL61 | GL62 | GL63 |
| 01 | GL64 | GL65 | GL66 | …… | GL125 | GL126 | GL127 |
| 10 | G128 | GL129 | GL130 | …… | GL189 | GL190 | GL191 |
| 11 | GL192 | GL193 | GL194 | …… | GL253 | GL254 | GL255 |
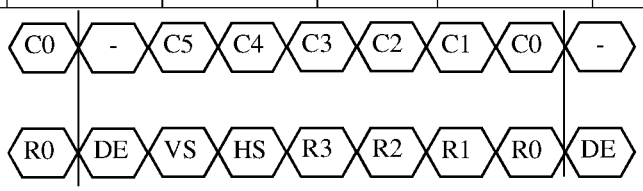
Fig. 4
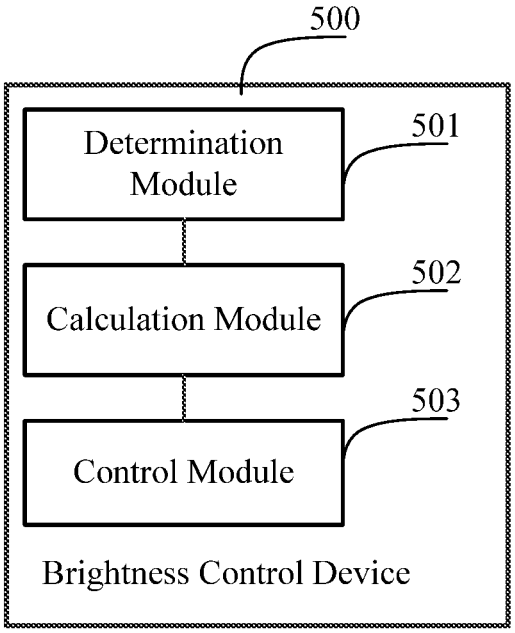
Fig.5

BRIGHTNESS CONTROL METHOD, BRIGHTNESS CONTROL DEVICE, ACTIVE-MATRIX ORGANIC LIGHT-EMITTING DIODE PANEL AND ELECTRONIC DEVICE

CROSS-REFERENCE TO RELATED APPLICATION

This application is the U.S. national phase of PCT Application No. PCT/CN2017/089475 filed on Jun. 22, 2017, which claims a priority of the Chinese Patent Application No. 201610851741.X filed on Sep. 26, 2016, the disclosures of which are incorporated in their entirety by reference herein.

TECHNICAL FIELD

The present disclosure relates to the field of liquid crystal display technology, in particular to a brightness control method, a brightness control device, an active-matrix organic light-emitting diode (AMOLED) panel and an electronic device.

BACKGROUND

As a commonly-used function of a display panel, a brightness control function is used to control a brightness value of a display panel. For a conventional liquid crystal display (LCD) panel, a voltage output mode for pulse width modulation (PWM) is adjusted by a light-emission diode (LED)-driver integrated circuit (IC), so as to control the brightness value of a backlight source, thereby to control the brightness of the LCD panel. However, some display panels, e.g., AMOLED panels, are not provided any backlight modules. For the AMOLED panel, a metal-oxide semiconductor (MOS) transistor is energized by a potential difference between a positive power supply voltage ELVDD and a negative power supply voltage ELVSS generated by a power IC, so as to generate a current to drive an OLED to emit light. A source IC outputs a data signal, and a driving thin film transistor (TFT) cooperates with a switching TFT so as to perform pixel display control. Currently, it is impossible to adjust the brightness of the AMOLED panel in a 256-grayscale (which also may be referred to gamma-level since the grayscale is adjusted by adjusting the gamma voltage) manner.

SUMMARY

An object of the present disclosure is to provide a brightness control method, a brightness control device, an AMOLED panel and an electronic device, so as to adjust the brightness of the AMOLED panel in a 256-grayscale (gamma-level) manner.

In one aspect, the present disclosure provides in some embodiments a brightness control method for use in an AMOLED panel including an electroluminescent element, including steps of: determining a brightness value L to be displayed by the AMOLED panel in accordance with a received brightness adjustment instruction; calculating an actual brightness value L' to be outputted by the electroluminescent element corresponding to the brightness value L in accordance with a predetermined brightness relationship, the actual brightness value L' corresponding to one grayscale; and controlling a data output unit to output a voltage signal corresponding to the actual brightness value L'.

In a possible embodiment of the present disclosure, the predetermined brightness relationship is that the actual brightness value L' outputted by the electroluminescent element is equal to the brightness value L to be displayed multiplied by a gain coefficient K. The step of calculating the actual brightness value L' to be outputted by the electroluminescent element corresponding to the brightness value L in accordance with the predetermined brightness relationship includes acquiring the gain coefficient K of the AMOLED panel, and acquiring a product of the brightness value L and the gain coefficient K as the actual brightness value L' to be outputted by the electroluminescent element, and the gain coefficient K is a ratio of a maximum light-emitting brightness value $L'_{GL255}$ of the electroluminescent element to a maximum brightness value $L_{GL255}$ to be displayed by the AMOLED panel.

In a possible embodiment of the present disclosure, the step of acquiring the gain coefficient K of the AMOLED panel includes addressing a register, and reading the gain coefficient K of the AMOLED panel stored in the register.

In a possible embodiment of the present disclosure, prior to the step of addressing the register and reading the gain coefficient K of the AMOLED panel stored in the register, the brightness control method further includes: measuring the maximum light-emitting brightness value $L'_{GL255}$ of the electroluminescent element and the maximum brightness value $L_{GL255}$ to be displayed by the AMOLED panel; and calculating the ratio of the maximum light-emitting brightness value $L'_{GL255}$ to the maximum brightness value $L_{GL255}$, and taking the ratio as the gain coefficient K of the AMOLED panel.

In a possible embodiment of the present disclosure, an actual brightness value outputted by the electroluminescent element corresponding to each grayscale and a position of each actual brightness value in the register are further stored in the register.

In another aspect, the present disclosure provides in some embodiments a brightness control device for use in an AMOLED panel including an electroluminescent element, including: a determination module configured to determine a brightness value L to be displayed by the AMOLED panel in accordance with a received brightness adjustment instruction; a first calculation module configured to calculate an actual brightness value L' to be outputted by the electroluminescent element corresponding to the brightness value L in accordance with a predetermined brightness relationship, the actual brightness value L' corresponding to one grayscale; and a control module configured to control a data output unit to output a voltage signal corresponding to the actual brightness value L'.

In a possible embodiment of the present disclosure, the predetermined brightness relationship is that the actual brightness value L' outputted by the electroluminescent element is equal to the brightness value L to be displayed multiplied by a gain coefficient K. The first calculation module is further configured to acquire the gain coefficient K of the AMOLED panel, and acquire a product of the brightness value L and the gain coefficient K as the actual brightness value L' to be outputted by the electroluminescent element, and the gain coefficient K is a ratio of a maximum light-emitting brightness value $L'_{GL255}$ of the electroluminescent element to a maximum brightness value $L_{GL255}$ to be displayed by the AMOLED panel.

In a possible embodiment of the present disclosure, the brightness control device further includes a register, and the first calculation module is further configured to address the register, read the gain coefficient K of the AMOLED panel stored in the register, and acquire the product of the brightness value L and the gain coefficient K as the actual brightness value L' to be outputted by the electroluminescent element.

In a possible embodiment of the present disclosure, the brightness control device further includes: a measurement module configured to measure the maximum light-emitting brightness value $L'_{GL255}$ of the electroluminescent element and the maximum brightness value $L_{GL255}$ to be displayed by the AMOLED panel; and a second calculation module configured to calculate the ratio of the maximum light-emitting brightness value $L'_{GL255}$ to the maximum brightness value $L_{GL255}$, and take the ratio as the gain coefficient K of the AMOLED panel.

In a possible embodiment of the present disclosure, an actual brightness value outputted by the electroluminescent element corresponding to each grayscale and a position of the register corresponding to each actual brightness value are further stored in the register.

In yet another aspect, the present disclosure provides in some embodiments an AMOLED panel including the above-mentioned brightness control device.

In still yet another aspect, the present disclosure provides in some embodiments an electronic device including the above-mentioned brightness control device.

According to the embodiments of the present disclosure, the brightness value L to be displayed by the AMOLED panel is determined in accordance with the received brightness adjustment instruction. Next, the actual brightness value L' to be outputted by the electroluminescent element corresponding to the brightness value L is calculated in accordance with the predetermined brightness relationship, and the actual brightness value L' corresponds to one grayscale (gamma level). Then, the data output unit is controlled to output the voltage signal corresponding to the actual brightness value L'. As a result, it is able to adjust the brightness value corresponding to each grayscale (gamma level), thereby to adjust the brightness value of the AMOLED panel in a 256-graysacle (gamma-level) manner.

BRIEF DESCRIPTION OF THE DRAWINGS

FIG. 3 is a schematic view showing items stored in a register according to one embodiment of the present disclosure;

FIG. 4 is another schematic view showing the items stored in the register according to one embodiment of the present disclosure;

FIG. 5 is a schematic view showing a brightness control device according to one embodiment of the present disclosure.

DETAILED DESCRIPTION OF THE EMBODIMENTS

In order to make the objects, the technical solutions and the advantages of the present disclosure more apparent, the present disclosure will be described hereinafter in a clear and complete manner in conjunction with the drawings and embodiments. Obviously, the following embodiments merely relate to a part of, rather than all of, the embodiments of the present disclosure, and based on these embodiments, a person skilled in the art may, without any creative effort, obtain the other embodiments, which also fall within the scope of the present disclosure.

Unless otherwise defined, any technical or scientific term used herein shall have the common meaning understood by a person of ordinary skills. Such words as "first" and "second" used in the specification and claims are merely used to differentiate different components rather than to represent any order, number or importance. Similarly, such words as "one" or "one of" are merely used to represent the existence of at least one member, rather than to limit the number thereof. Such words as "connect" or "connected to" may include electrical connection, direct or indirect, rather than to be limited to physical or mechanical connection. Such words as "on", "under", "left" and "right" are merely used to represent relative position relationship, and when an absolute position of the object is changed, the relative position relationship will be changed too.

Figure 1:
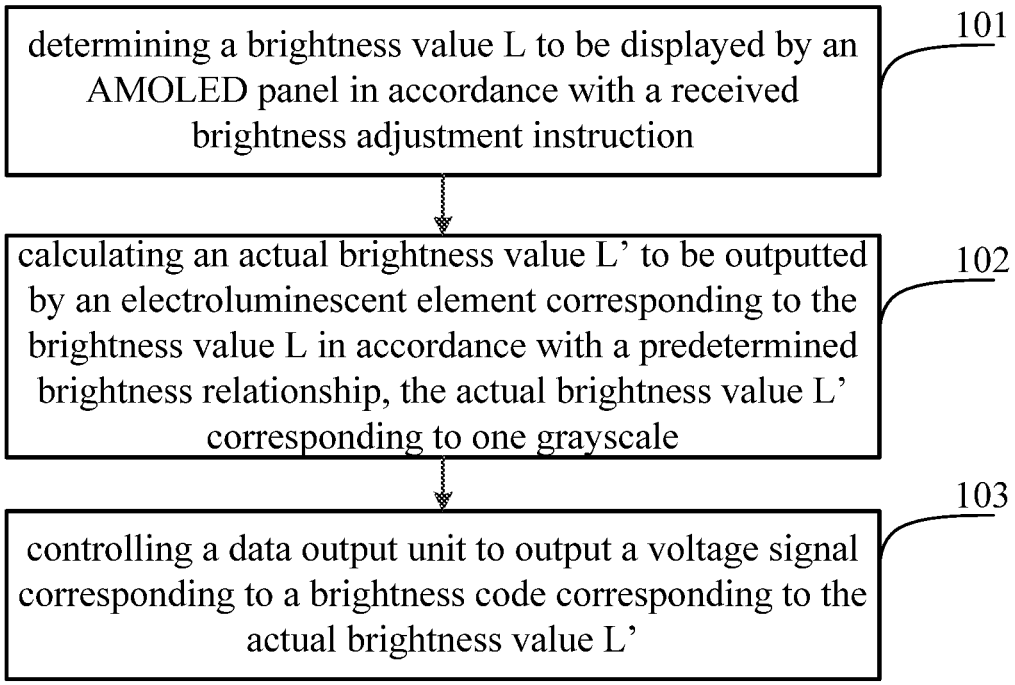
FIG. 1 is a flow chart of a brightness control method according to one embodiment of the present disclosure.

The present disclosure provides in some embodiments a brightness control method for use in an AMOLED panel including an electroluminescent element, which, as shown in FIG. 1, includes: Step 101 of determining a brightness value L (i.e., a first brightness value) to be displayed by the AMOLED panel in accordance with a received brightness adjustment instruction; Step 102 of calculating an actual brightness value L'(i.e., a second brightness value) to be outputted by the electroluminescent element corresponding to the brightness value L in accordance with a predetermined brightness relationship, the actual brightness value L' corresponding to one grayscale (gamma level); and Step 103 of controlling a data output unit to output a voltage signal corresponding to the actual brightness value L'(i.e., a brightness code).

In the embodiments of the present disclosure, the received brightness adjustment instruction may be transmitted by a remote control device (e.g., a remote controller, a mobile phone or a flat-panel computer), or transmitted by a physical button. Upon the receipt of the brightness adjustment instruction, the brightness value L to be displayed by the AMOLED panel may be determined.

In a possible embodiment of the present disclosure, the predetermined brightness relationship is that the actual brightness value L' outputted by the electroluminescent element is equal to the brightness value L to be displayed multiplied by a gain coefficient K. In other words, in Step 102, the actual brightness value L' outputted by the electroluminescent element corresponding to the brightness value L may be determined in accordance with the gain coefficient K. Of course, the brightness relationship is not limited to the above, and any other brightness relationship may be applied, which will not be particularly defined herein. In addition, the electroluminescent element may be an OLED.

In addition, the calculated actual brightness value L' outputted by the electroluminescent element may be a numerical value or a brightness code.

The actual brightness value L' corresponds to a grayscale, so it is able to achieve different grayscales through different actual brightness values L' outputted by the electroluminescent element, i.e., each actual output brightness value corresponds to one grayscale. For example, each actual brightness value L' may correspond to one of 256 grayscales, so it is able to adjust the brightness of the AMOLED panel in a 256-grayscale manner like the LCD. However, in order to meet different requirements in some scenarios, each actual brightness value L' may also correspond to one of the grayscales in the other amount, which will not be particularly defined herein.

The voltage signal outputted in Step 103 corresponds to the above-mentioned actual brightness value L', so it is able for the electroluminescent element to output the actual brightness value L', thereby to change the brightness value of the AMOLED panel and change the grayscale of the AMOLED panel to a grayscale corresponding to the actual brightness value L'. In addition, in the embodiments of the present disclosure, a voltage outputted by the data output unit corresponds to, i.e., depends on, an actual output brightness value of the electroluminescent element.

In addition, the above-mentioned method may be implemented by an integrated circuit (IC), e.g., a driver IC, i.e., it may be implemented by the AMOLED panel or an electronic device including the IC.

According to the embodiments of the present disclosure, the brightness value L to be displayed by the AMOLED panel is determined in accordance with the received brightness adjustment instruction. Next, the actual brightness value L' to be outputted by the electroluminescent element corresponding to the brightness value L is calculated in accordance with the predetermined brightness relationship, and the actual brightness value L' corresponds to one grayscale. Then, the data output unit is controlled to output the voltage signal corresponding to the actual brightness value L'. As a result, it is able to adjust the grayscale by adjusting the voltage signal, thereby to adjust the brightness value of the AMOLED panel in a 256-graysacle manner.

Figure 2:
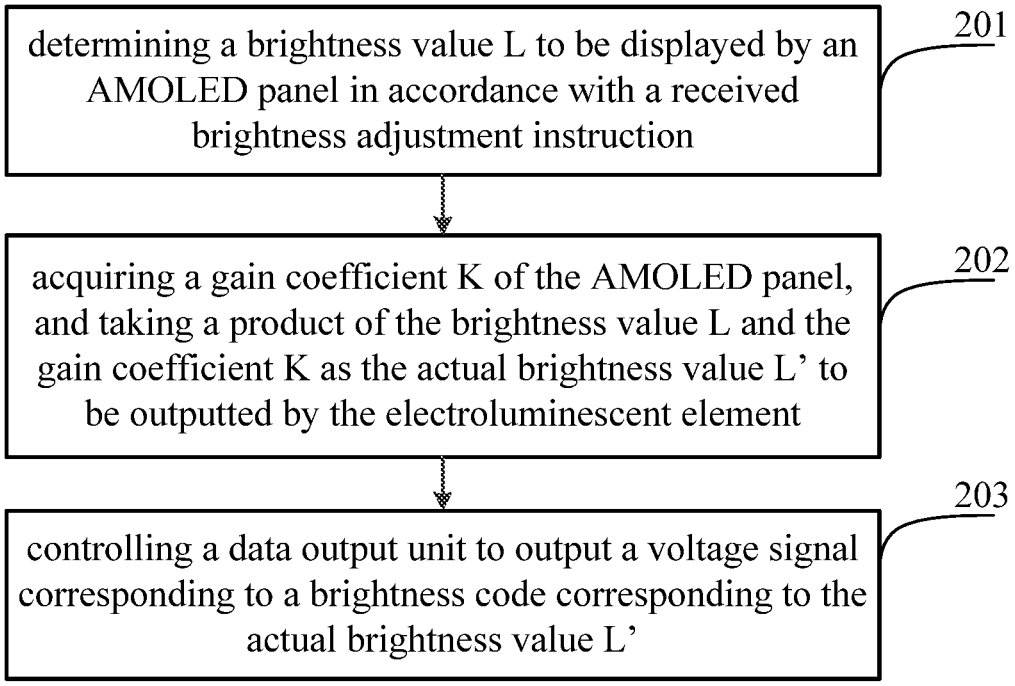
FIG. 2 is another flow chart of the brightness control method according to one embodiment of the present disclosure.

As shown in FIG. 2 which is another flow chart of the brightness control method, the brightness control method includes: Step 201 of determining the brightness value L to be displayed by the AMOLED panel in accordance with the received brightness adjustment instruction; Step 202 of acquiring a gain coefficient K of the AMOLED panel, and taking a product of the brightness value L and the gain coefficient K as the actual brightness value L' to be outputted by the electroluminescent element, the gain coefficient K being a ratio of a maximum light-emitting brightness value $L'_{GL255}$ of the electroluminescent element to a maximum brightness value $L_{GL255}$ to be displayed by the AMOLED panel; and Step 203 of controlling the data output unit to output the voltage signal corresponding to the actual brightness value L'.

In other words, $L'_{display}=K*L_{display}$, where $$K = \frac{L'_{GL255}}{L_{GL255}} \text{ or } K_{R/G/B} = \frac{L'_{GL255}}{L_{GL255}},$$

K represents the gain coefficient, $L'_{display}$ represents the actual brightness value L' to be outputted by the electroluminescent element, $L_{display}$ represents the brightness value L to be displayed by the AMOLED panel, $L'_{GL255}$ represents the maximum light-emitting brightness value, $L_{GL255}$ represents the maximum brightness value to be displayed by the AMOLED panel, R represents red, G represents green and B represents blue.

In addition, the above equation may be acquired through inference as follows.

$$\frac{L_{display}}{L_{GL255}} = \left(\frac{GL_{display}}{2^8}\right)^{2.2}, \frac{L'_{display}}{L'_{GL255}} = \left(\frac{GL'_{display}}{2^8}\right)^{2.2}, \text{ and}$$

-continued $$\frac{L_{display}}{L_{GL255}} = \frac{L'_{display}}{L'_{GL255}} \rightarrow L'_{display} = \frac{L_{display}}{L_{GL255}} \times L'_{GL255} = \frac{L'_{GL255}}{L_{GL255}} \times L_{display},$$

where $GL_{display}$ represents a grayscale to be displayed by the AMOLED panel corresponding to the brightness value L, $GL'_{display}$ represents an actual grayscale to be outputted by the electroluminescent element and corresponding to the actual brightness value L', and $GL_{display}$ is equal to $GL_{display}$.

On the basis of the above-mentioned equations, the following equation may be acquired: $L'_{display}=K*L_{display}$, where $$K = \frac{L'_{GL255}}{L_{GL255}} \text{ or } K_{R/G/B} = \frac{L'_{GL255}}{L_{GL255}}.$$

In a possible embodiment of the present disclosure, the step of acquiring the gain coefficient K of the AMOLED panel includes addressing a register, and reading the gain coefficient K of the AMOLED panel stored in the register.

In the embodiments of the present disclosure, the gain coefficient K may be pre-stored in the register, so as to determine the actual brightness value L' to be outputted by the electroluminescent element quickly.

Of course, in the embodiments of the present disclosure, the gain coefficient K is unnecessarily pre-stored. For example, the gain coefficient K may be calculated in accordance with the maximum light-emitting brightness value $L'_{GL255}$ of the electroluminescent element and the maximum brightness value $L_{GL255}$ to be displayed by the AMOLED panel, i.e., the ratio of the electroluminescent element to the maximum brightness value $L_{GL255}$ to be displayed by the AMOLED panel may be taken as the gain coefficient K.

In a possible embodiment of the present disclosure, prior to the step of addressing the register and reading the gain coefficient K of the AMOLED panel stored in the register, the brightness control method further includes: measuring the maximum light-emitting brightness value $L'_{GL255}$ of the electroluminescent element and the maximum brightness value $L_{GL255}$ to be displayed by the AMOLED panel; and calculating the ratio of the maximum light-emitting brightness value $L'_{GL255}$ to the maximum brightness value $L_{GL255}$, and taking the ratio as the gain coefficient K of the AMOLED panel.

The driver IC may be tuned, so as to measure the maximum light-emitting brightness value $L'_{GL255}$ of the electroluminescent element and the maximum brightness value $L_{GL255}$ to be displayed by the AMOLED panel, and then the ratio of the maximum light-emitting brightness value $L'_{GL255}$ to the maximum brightness value $L_{GL255}$ may be taken as the gain coefficient K of the AMOLED panel. Of course, it is unnecessary to calculate the gain coefficient K of each AMOLED panel in some scenarios. For example, the AMOLED panels of an identical type or identical parameters may share an identical gain coefficient K. In addition, the calculated coefficient K may be stored in the register. In the case of brightness adjustment, it is able to directly read the gain coefficient K from the register rather than calculate the gain coefficient K each time the adjustment is performed, so as to reduce the power consumption.

In a possible embodiment of the present disclosure, an actual brightness value outputted by the electroluminescent element corresponding to each grayscale and a position of each actual brightness value in the register are further stored in the register.

In the embodiments of the present disclosure, the actual brightness values to be outputted by the electroluminescent element corresponding to the grayscales and the position of each actual brightness value in the register may be pre-stored in the register, so it is able to determine the grayscale corresponding to each actual brightness value L' quickly in accordance with its position in the register. For example, the actual brightness values to be outputted by the electroluminescent element corresponding to the 256 grayscales and the position of each actual brightness value in the register may be pre-stored in the register.

In addition, the register and the data output unit may be integrated into the driver IC. In this way, through a corresponding algorithm relationship (i.e., the gain coefficient K) in the driver IC, it is merely necessary for the driver IC, in the case of operating, to call the actual brightness value L', thereby to adjust the brightness and the grayscale.

The following description is given in the case that the actual brightness values corresponding to 256 grayscales (gamma levels) are stored in the register. FIGS. 3 and 4 show the actual brightness values corresponding to 256 grayscales (gamma levels) and the positions thereof in the register. In FIG. 3, the table includes the actual brightness values (L0 to L255) corresponding to the grayscales (gamma levels) (GL0 to GL255). In addition, the table further includes brightness codes (C0 to C255) of the actual brightness values. The actual brightness values (L0 to L255) and the brightness codes (C0 to C255) may be recorded in the table through adjusting voltages for a maximum grayscale (high gamma level) and a minimum grayscale (low gamma level). In FIG. 4, the table is used for addressing the table in FIG. 3, i.e., recording the positions of the actual brightness values corresponding to the grayscales (gamma levels) in the register. C0-C5 and R0-R3 are for illustratively purposes only, and they are used to represent columns and rows respectively. DE, HS and VS represent an enable signal, a row synchronization signal and a column synchronization signal respectively. In addition, the table in FIG. 4 may be in a 8-bit form.

In addition, the tables in FIGS. 3 and 4 may be acquired as follows.

At first, a first turning may be performed by the driver IC so as to enable the electroluminescent element to emit light at the maximum brightness value. A grayscale adjustment (gamma tuning) operation may be performed, and the actual brightness value, its position in the register and the corresponding grayscale (gamma level) may be measured and stored in the formats in FIGS. 3 and 4 in an IC, i.e., the register.

Then, a second turning may be performed by the driver IC so as to enable the electroluminescent element to emit light at the second largest brightness value. A grayscale (gamma level) adjustment (gamma tuning) operation may be performed, and the actual brightness value, its position in the register and the corresponding grayscale (gamma level) may be measured and stored in the formats in FIGS. 3 and 4 in the IC, i.e., the register.

Similarly, the other actual brightness values, their positions in the register and the corresponding grayscales (gamma levels) may be measured and stored in the formats in FIGS. 3 and 4 in the IC, i.e., the register. In other words, through a plurality of tuning operations, it is able to acquire the tables in FIGS. 3 and 4.

Usually, the gamma register is of a 10-bit form, so theoretically $L'_{GL255}$ may be changed in 1024 ($2^{10}$) levels, but it is impossible to differentiate the low grayscales (gamma levels). The brightness values of the electroluminescent element (e.g., an OLED) may fall within a certain range, and in the case that the brightness value corresponding to the grayscale is smaller than a certain value, it is impossible for the electroluminescent element to differentiate the grayscale. Hence, it is merely necessary to adjust the voltage applied to the electroluminescent element from a voltage corresponding to the maximum brightness value (GL255) to a voltage corresponding to a brightness value approximate to the minimum brightness value within the range, e.g., about 4/255 of the maximum brightens value. For example, grayscale (gamma level) L2 corresponds to a voltage of about 3V, i.e., from the maximum brightness value corresponding GL255 to the adjustable minimum brightness value, the voltage to be applied to the electroluminescent element may be changed within the range of 4.5V to 3V, and $L'_{GL255}$ may be changed in ($2^{10}$-887) levels. Hence, the brightness control method in the embodiments of the present disclosure is advantageous over the related art where gamma curves corresponding to 256 brightness values are stored in the IC.

The AMOLED panel or the electronic device may acquire the two tables through, but not limited to, the above-mentioned ways. For example, the AMOLED panel or the electronic device may acquire the two tables inputted by a user, or from another device.

Various possible embodiments are provided in FIG. 2 on the basis of the embodiment as shown in FIG. 1, and identically it is able to adjust the brightness of the AMOLED panel in a 256-grayscale (gamma-level) manner.

The present disclosure further provides in some embodiments a brightness control device 500 for use in an AMOLED panel including an electroluminescent element, which, as shown in FIG. 5, includes: a determination module 501 configured to determine a brightness value L to be displayed by the AMOLED panel in accordance with a received brightness adjustment instruction; a first calculation module 502 configured to calculate an actual brightness value L' to be outputted by the electroluminescent element corresponding to the brightness value L in accordance with a predetermined brightness relationship, the actual brightness value L' corresponding to one grayscale; and a control module 503 configured to control a data output unit to output a voltage signal corresponding to the actual brightness value L'.

In a possible embodiment of the present disclosure, the predetermined brightness relationship is that the actual brightness value L' outputted by the electroluminescent element is equal to the brightness value L to be displayed multiplied by a gain coefficient K. The first calculation module is further configured to acquire the gain coefficient K of the AMOLED panel, and acquire a product of the brightness value L and the gain coefficient K as the actual brightness value L' to be outputted by the electroluminescent element, and the gain coefficient K is a ratio of a maximum light-emitting brightness value $L'_{GL255}$ of the electroluminescent element to a maximum brightness value $L_{GL255}$ to be displayed by the AMOLED panel.

In a possible embodiment of the present disclosure, the brightness control device further includes a register, and the first calculation module is further configured to address the register, read the gain coefficient K of the AMOLED panel stored in the register, and acquire the product of the brightness value L and the gain coefficient K as the actual brightness value L' to be outputted by the electroluminescent element.

Figure 6:
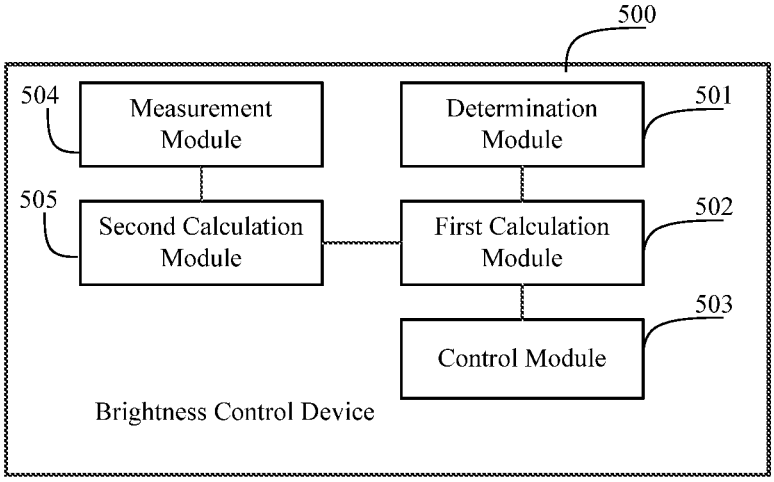
FIG. 6 is another schematic view showing the brightness control device according to one embodiment of the present disclosure.

In a possible embodiment of the present disclosure, as shown in FIG. 6, the brightness control device 500 further includes: a measurement module 504 configured to measure the maximum light-emitting brightness value $L'_{GL255}$ of the electroluminescent element and the maximum brightness value $L_{GL255}$ to be displayed by the AMOLED panel; and a second calculation module 505 configured to calculate the ratio of the maximum light-emitting brightness value $L'_{GL255}$ to the maximum brightness value $L_{GL255}$, and take the ratio as the gain coefficient K of the AMOLED panel.

In a possible embodiment of the present disclosure, an actual brightness value outputted by the electroluminescent element corresponding to each grayscale and a position of the register corresponding to each actual brightness value are further stored in the register.

The brightness control device is capable of executing the procedures in the method embodiments in FIGS. 1 to 2, which will not be particularly defined herein. Identically, it is able for the brightness control device to adjust the brightness of the AMOLED panel in a 256-grayscale manner.

The present disclosure further provides in some embodiments an AMOLED panel including the above-mentioned brightness control device.

The present disclosure further provides in some embodiments an electronic device including the above-mentioned brightness control device.

The above are merely the preferred embodiments of the present disclosure, but the present disclosure is not limited thereto. Obviously, a person skilled in the art may make further modifications and improvements without departing from the spirit of the present disclosure, and these modifications and improvements shall also fall within the scope of the present disclosure.

What is claimed is:

1. A brightness control method for use in an active matrix organic light-emitting diode panel comprising an electroluminescent element, comprising steps of:

determining a brightness value L to be displayed by the active matrix organic light-emitting diode panel in accordance with a received brightness adjustment instruction;

calculating an actual brightness value L' to be outputted by the electroluminescent element corresponding to the brightness value L in accordance with a predetermined brightness relationship, the actual brightness value L' corresponding to one grayscale; and controlling a data output unit to output a voltage signal corresponding to the actual brightness value L';

wherein the predetermined brightness relationship is defined such that the actual brightness value L' outputted by the electroluminescent element is equal to the brightness value L to be displayed multiplied by a gain coefficient K;

wherein the step of calculating the actual brightness value L' to be outputted by the electroluminescent element corresponding to the brightness value L in accordance with the predetermined brightness relationship comprises acquiring the gain coefficient K of the active matrix organic light-emitting diode panel, and acquiring a product of the brightness value L and the gain coefficient K as the actual brightness value L' to be outputted by the electroluminescent element; and wherein the gain coefficient K is a ratio of a maximum light-emitting brightness value $L'_{GL255}$ of the electroluminescent element to a maximum brightness value $L_{GL255}$ to be displayed by the active matrix organic light-emitting diode panel.

2. The brightness control method according to claim 1, wherein the step of acquiring the gain coefficient K of the active matrix organic light-emitting diode panel comprises addressing a register, and reading the gain coefficient K of the active matrix organic light-emitting diode panel stored in the register.

3. The brightness control method according to claim 2, wherein prior to the step of addressing the register and reading the gain coefficient K of the active matrix organic light-emitting diode panel stored in the register, the brightness control method further comprises:

measuring the maximum light-emitting brightness value $L'_{GL255}$ of the electroluminescent element and the maximum brightness value $L_{GL255}$ to be displayed by the active matrix organic light-emitting diode panel; and calculating the ratio of the maximum light-emitting brightness value $L'_{GL255}$ to the maximum brightness value $L_{GL255}$ and taking the ratio as the gain coefficient K of the active matrix organic light-emitting diode panel.

4. The brightness control method according to claim 3, wherein an actual brightness value outputted by the electroluminescent element corresponding to each grayscale and a position of each actual brightness value in the register are further stored in the register.

5. The brightness control method according to claim 2, wherein the actual brightness value L' outputted by the electroluminescent element corresponding to each grayscale and a position of each actual brightness value L' in the register are further stored in the register.

6. A brightness control device for use in an active matrix organic light-emitting diode panel comprising an electroluminescent element, comprising:

a determination module configured to determine a brightness value L to be displayed by the active matrix organic light-emitting diode panel in accordance with a received brightness adjustment instruction;

a first calculation module configured to calculate an actual brightness value L' to be outputted by the electroluminescent element corresponding to the brightness value L in accordance with a predetermined brightness relationship, the actual brightness value L' corresponding to one grayscale; and a control module configured to control a data output unit to output a voltage signal corresponding to the actual brightness value L';

wherein the predetermined brightness relationship is defined such that the actual brightness value L' outputted by the electroluminescent element is equal to the brightness value L to be displayed multiplied by a gain coefficient K;

wherein the first calculation module is further configured to acquire the gain coefficient K of the active matrix organic light-emitting diode panel, and acquire a product of the brightness value L and the gain coefficient K as the actual brightness value L' to be outputted by the electroluminescent element; and wherein the gain coefficient K is a ratio of a maximum light-emitting brightness value $L'_{GL255}$ of the electroluminescent element to a maximum brightness value $L_{GL255}$ to be displayed by the active matrix organic light-emitting diode panel.

7. The brightness control device according to claim 6, further comprising a register, wherein the first calculation module is further configured to address the register, read the gain coefficient K of the active matrix organic light-emitting diode panel stored in the register, and acquire the product of the brightness value L and the gain coefficient K as the actual brightness value L' to be outputted by the electroluminescent element.

8. The brightness control device according to claim 7, further comprising:

a measurement module configured to measure the maximum light-emitting brightness value $L'_{GL255}$ of the electroluminescent element and the maximum brightness value $L_{GL255}$ to be displayed by the active matrix organic light-emitting diode panel; and a second calculation module configured to calculate the ratio of the maximum light-emitting brightness value $L'_{GL255}$ to the maximum brightness value $L_{GL255}$ and take the ratio as the gain coefficient K of the active matrix organic light-emitting diode panel.

9. The brightness control device according to claim 8, wherein an actual brightness value outputted by the electroluminescent element corresponding to each grayscale and a position of each actual brightness value in the register are further stored in the register.

10. The brightness control device according to claim 7, wherein the actual brightness value L' outputted by the electroluminescent element corresponding to each grayscale and a position of each actual brightness value L' in the register are further stored in the register.

11. An active matrix organic light-emitting diode panel, comprising the brightness control device according to claim 6.

12. The active matrix organic light-emitting diode panel according to claim 11, further comprising a register, wherein the first calculation module is further configured to address the register, read the gain coefficient K of the active matrix organic light-emitting diode panel stored in the register, and acquire the product of the brightness value L and the gain coefficient K as the actual brightness value L' to be outputted by the electroluminescent element.

13. The active matrix organic light-emitting diode panel according to claim 12, further comprising:

a measurement module configured to measure the maximum light-emitting brightness value $L'_{GL255}$ of the electroluminescent element and the maximum brightness value $L_{GL255}$ to be displayed by the active matrix organic light-emitting diode panel; and a second calculation module configured to calculate the ratio of the maximum light-emitting brightness value $L'_{GL255}$ to the maximum brightness value $L_{GL255}$ and take the ratio as the gain coefficient K of the active matrix organic light-emitting diode panel.

14. The active matrix organic light-emitting diode panel according to claim 12, wherein an actual brightness value outputted by the electroluminescent element corresponding to each grayscale and a position of each actual brightness value in the register are further stored in the register.

15. An electronic device, comprising the brightness control device according to claim 6.

16. The electronic device according to claim 15, further comprising a register, wherein the first calculation module is further configured to address the register, read the gain coefficient K of the active matrix organic light-emitting diode panel stored in the register, and acquire the product of the brightness value L and the gain coefficient K as the actual brightness value L' to be outputted by the electroluminescent element.

17. The electronic device according to claim 16, further comprising:

a measurement module configured to measure the maximum light-emitting brightness value $L'_{GL255}$ of the electroluminescent element and the maximum brightness value $L_{GL255}$ to be displayed by the active matrix organic light-emitting diode panel; and a second calculation module configured to calculate the ratio of the maximum light-emitting brightness value $L'_{GL255}$ to the maximum brightness value $L_{GL255}$ and take the ratio as the gain coefficient K of the active matrix organic light-emitting diode panel.

18. The electronic device according to claim 16, wherein the actual brightness value L' outputted by the electroluminescent element corresponding to each grayscale and a position of each actual brightness value L' in the register are further stored in the register.

* * * * *